US008684209B2

(12) United States Patent
Choi

(10) Patent No.: US 8,684,209 B2
(45) Date of Patent: Apr. 1, 2014

(54) FOLDABLE AND OVERLAPPABLE CARRIER BOX

(71) Applicant: National Plastic Co., Ltd., Ansan-si (KR)

(72) Inventor: Byung Min Choi, Suwon-si (KR)

(73) Assignee: National Plastic Co., Ltd. (KR)

( * ) Notice: Subject to any disclaimer, the term of this patent is extended or adjusted under 35 U.S.C. 154(b) by 0 days.

(21) Appl. No.: 13/677,587

(22) Filed: Nov. 15, 2012

(65) Prior Publication Data

US 2013/0180982 A1 Jul. 18, 2013

(30) Foreign Application Priority Data

Jan. 16, 2012 (KR) ..... 10-2012-0004708

(51) Int. Cl.
*B65D 21/04* (2006.01)
*B65D 21/02* (2006.01)

(52) U.S. Cl.
CPC ..... *B65D 21/041* (2013.01); *B65D 21/04* (2013.01); *B65D 21/02* (2013.01)
USPC ..... 220/6; 206/507; 206/505

(58) Field of Classification Search
CPC .. B65D 21/041; B65D 21/04; B65D 21/0233; B65D 21/02
USPC ..... 206/600, 386, 505, 507, 509, 518, 517, 206/520, 519, 515, 506, 503; 229/917, 915, 229/103; 220/4.01
See application file for complete search history.

(56) References Cited

U.S. PATENT DOCUMENTS

| | | | | | |
|---|---|---|---|---|---|
| 593,316 | A | * | 11/1897 | Woodman | 220/573.4 |
| 2,029,746 | A | * | 2/1936 | Tufts et al. | 206/506 |
| 3,348,723 | A | * | 10/1967 | Wilson | 220/6 |
| 3,907,150 | A | * | 9/1975 | Jurasek | 220/485 |
| 4,023,698 | A | * | 5/1977 | Joseph | 220/7 |
| 4,759,451 | A | * | 7/1988 | Apps | 211/126.4 |
| 4,917,255 | A | * | 4/1990 | Foy et al. | 220/6 |

(Continued)

FOREIGN PATENT DOCUMENTS

| | | | | |
|---|---|---|---|---|
| JP | 57-114635 | | 7/1982 | C22C 21/12 |
| JP | 10129670 | A * | 5/1998 | B65D 21/02 |

(Continued)

OTHER PUBLICATIONS

Office Action of KR Application No. 10-2012-0004708, May 9, 2013, 5 pages.

*Primary Examiner* — Robert J Hicks
(74) *Attorney, Agent, or Firm* — Sunstein Kann Murphy & Timbers LLP

(57) ABSTRACT

A foldable and overlappable carrier box includes a base panel, a pair of first side panels erected along any two facing edges of the base panel, and a pair of second side panels erected along remaining facing edges of the base panel. Each of the first side panels is divided into an upper face and a lower face along a horizontal line, the upper face being foldable downwards, and each of the second side panels is divided into an upper portion and a lower portion along a horizontal line, so that when carrier boxes are stacked in multiple layers by folding the upper face, a lower portion of a carrier box located at an upper position is overlappable with an upper portion of a carrier box located at a lower position.

7 Claims, 13 Drawing Sheets

(56) References Cited

U.S. PATENT DOCUMENTS

| | | | | |
|---|---|---|---|---|
| 5,161,709 | A * | 11/1992 | Oestreich, Jr. | 220/6 |
| 2008/0142530 | A1 * | 6/2008 | Meers et al. | 220/666 |
| 2008/0169285 | A1 * | 7/2008 | Marazita et al. | 220/7 |
| 2009/0057320 | A1 * | 3/2009 | Meers et al. | 220/660 |

FOREIGN PATENT DOCUMENTS

| | | | | |
|---|---|---|---|---|
| KR | 20-0290671 | | 7/2002 | B65D 21/00 |
| KR | 20-0365587 | | 10/2004 | B65D 6/16 |
| KR | 10-2005-0043074 | A | 5/2005 | B65D 21/02 |

* cited by examiner

- PRIOR ART -

FOLDABLE AND OVERLAPPABLE CARRIER BOX

CROSS REFERENCE

This application claims the benefit of Paris Convention KR/10-2012-0004708 filed Jan. 16, 2012, the content of which is incorporated herein by reference.

BACKGROUND OF THE INVENTION

1. Field of the Invention

The present invention relates to a foldable and overlappable carrier box, in which a short side panel thereof is erected when in use so that boxes can be stacked up, and the short side panel thereof is folded when in storage or collection so that the boxes can overlap each other.

2. Description of the Related Art

Foldable boxes are widely used. The foldable boxes are used to store or carry articles or the parts held therein and are folded when the box is in storage.

Such a foldable box is disclosed in Korean U.M. Registration No. 0365587 that was registered on Oct. 12, 2004 and is entitled 'Foldable Box'.

According to the above publication, as shown in FIG. 14, a foldable box 100 mainly includes a rectangular bottom panel 110, a pair of first side panels 120*a* and 120*b* that are placed on long sides of the bottom panel 110 in such a way as to face each other, and a pair of second side panels 130*a* and 130*b* that are placed on short sides of the bottom panel 110 in such a way as to face each other. When it is desired to fold the box 100 from an unfolded state, a user holds short-side frames 140*b* and 140*d* and handle portions 170 of the box 100 with his or her hands and then pushes the second side panels 130*a* and 130*b* so that they fold inwards. Further, the first side panels 120*a* and 120*b* are folded towards the interior of the box with respect to a central cutting line, hence folding the box.

However, the conventional foldable box 100 has drawbacks because a process of folding the box is complicated, which is inconvenient, and the cost of manufacturing the box is high.

There is also a conventional overlappable carrier box in which articles or parts are stored and carried, which is folded when the box is in storage.

The shape of such an overlappable box is that of a box that is open at its top, and is wide at its upper portion and narrow at its lower portion to make it easy to overlap and store boxes when not in use, with handle portions being rotatably provided on upper portions of sidewalls of the box across the sidewalls. Thus, when boxes are stacked up, the handle portions are placed across the sidewalls to stack one box on another box. In contrast, when the boxes are not in use, the handle portions of each box are rotated to be placed on both sidewalls, thus allowing the boxes to easily overlap each other.

However, such an overlappable carrier box has drawbacks in that the load is concentrated on the handle portions when the boxes up are stacked up, and the only portions of the boxes that overlap are constituted by thin sidewalls, so that the strength is very weak.

Further, unless one box is precisely placed on the handle portions of another box when stacking the boxes up, the box may undesirably fall down.

SUMMARY OF THE INVENTION

Accordingly, the present invention has been made keeping in mind the above problems occurring in the prior art, and an object of the present invention is to provide a foldable and overlappable carrier box, in which a short side panel thereof is erected when in use so that boxes can be stacked up, and the short side panel thereof is folded when in storage or collection so that the boxes can overlap each other.

In order to accomplish the above object, the present invention provides a foldable and overlappable carrier box, including a base panel; a pair of first side panels erected along any two facing edges of the base panel; and a pair of second side panels erected along remaining facing edges of the base panel, wherein each of the first side panels is divided into an upper face and a lower face along a horizontal line, the upper face being foldable downwards, and each of the second side panels is divided into an upper portion and a lower portion along a horizontal line, whereby, when carrier boxes are stacked in multiple layers by folding the upper face, a lower portion of a carrier box located at an upper position is overlappable with an upper portion of a carrier box located at a lower position.

According to the present invention, the base panel may have a rectangular shape, each of the first side panels may be a short side panel that is erected on a short side of the base panel, and each of the second side panels may be a long side panel that is erected on a long side of the base panel.

According to the present invention, a lower end of the upper face may be hingedly connected to an upper end of the lower face, and the upper face may be rotated inwards relative to the lower face to be folded.

According to the present invention, the upper face may be provided with a locking means to maintain the upper face in an erected state when the upper face is erected.

According to the present invention, a protruding portion may be formed on an outer surface of the lower portion in such a way as to protrude outwards, and a receiving portion may be formed on an inner surface of the upper portion to receive the protruding portion.

According to the present invention, a projecting portion may be formed on an inner surface of the upper portion in such a way as to protrude inwards, and a receiving groove may be formed on an outer surface of the lower portion to receive the projecting portion.

According to the present invention, the base panel may have a rectangular shape, each of the first side panels may be a long side panel that is erected on the long side of the base panel, and each of the second side panels may be a short side panel that is erected on the short side of the base panel.

The foldable and overlappable carrier box according to the present invention has the following effects.

When the carrier box is in use, upper faces of short side panels are erected to allow boxes to be stacked up with the contents held therein. In contrast, when the empty carrier box having no contents is stored or collected, the upper faces of the short side panels are folded to allow the boxes to overlap each other, thus reducing the volume.

Thus, high strength which is an advantage of a carrier box that can be folded, is achieved, and at the same time, it is easy to use and reduces the manufacturing cost which are the advantages of a carrier box that can be overlapped.

Moreover, a protruding portion is formed, so that the protruding portion comes into contact with an upper end of a long side panel even if short side panels do not come into contact with each other due to the carrier boxes being inaccurately stacked at the wrong positions, thus preventing a carrier box at an upper position from easily falling onto another carrier box at a lower position.

Further, a protrusion and a receiving groove are formed to minimize a lateral tolerance that may be increased between an upper box and a lower box when overlappable carrier boxes are stacked in multiple layers, thereby eliminating a lateral clearance.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
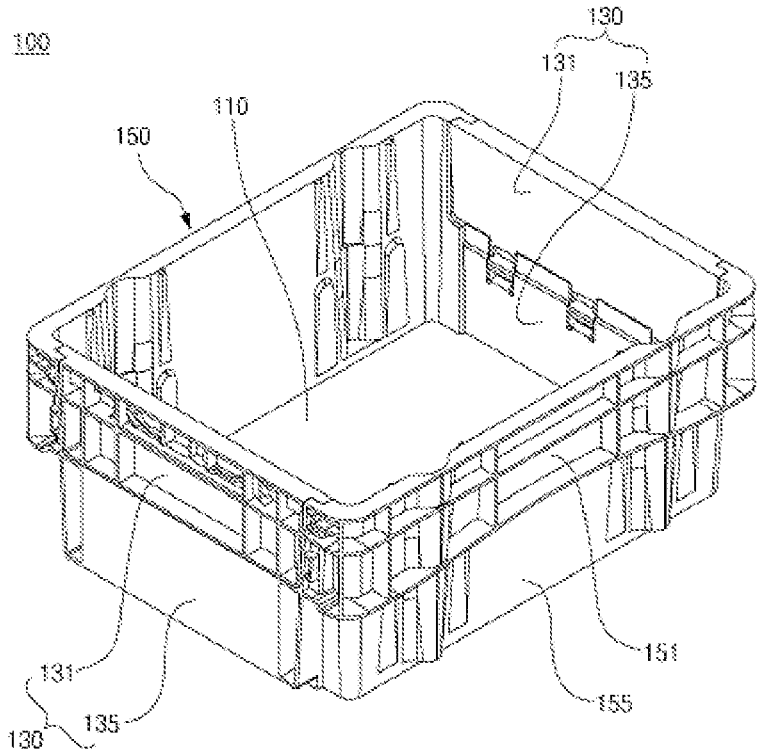
FIG. 1 is a perspective view showing a foldable and overlappable carrier box according to a preferred embodiment of the present invention.

Hereinafter, the preferred embodiments according to the present invention will be described in detail with reference to the accompanying drawings. The terminologies or words used in the description and the claims of the present invention should not be interpreted as being limited merely to common and dictionary meanings. On the contrary, they should be interpreted based on the meanings and concepts of the invention in keeping with the scope of the invention on the basis of the principle that the inventor(s) can appropriately define the terms in order to describe the invention in the best way.

Thus, it should be understood that the embodiments described herein and shown in the drawings are for illustrative purposes only, and various equivalents and modifications may be made in the invention without departing from the spirit and scope thereof.

As shown in FIG. 1, a foldable and overlappable carrier box 100 according to a preferred embodiment of the present invention includes a base panel 110, a pair of first side panels 130, and a pair of second side panels 150.

The base panel 110 forms a bottom of the carrier box 100, and has a rectangular shape in this embodiment. However, the base panel 110 is not limited thereto, and may have a square shape.

The pair of first side panels 130 is erected along any two facing edges of the base panel 110. In this embodiment, the first side panels 130 will be short side panels 130 that are erected on both sides of the base panel 110 having a shorter length.

Thus, each first side panel 130 will be described below as the short side panel 130, but may become a long side panel without being limited to the short side panel. Of course, the first side panel 130 may be the same size as the second side panel 150.

Such a short side panel 130 is divided into two portions along a horizontal line, that is, an upper face 131 and a lower face 135.

Figure 2:
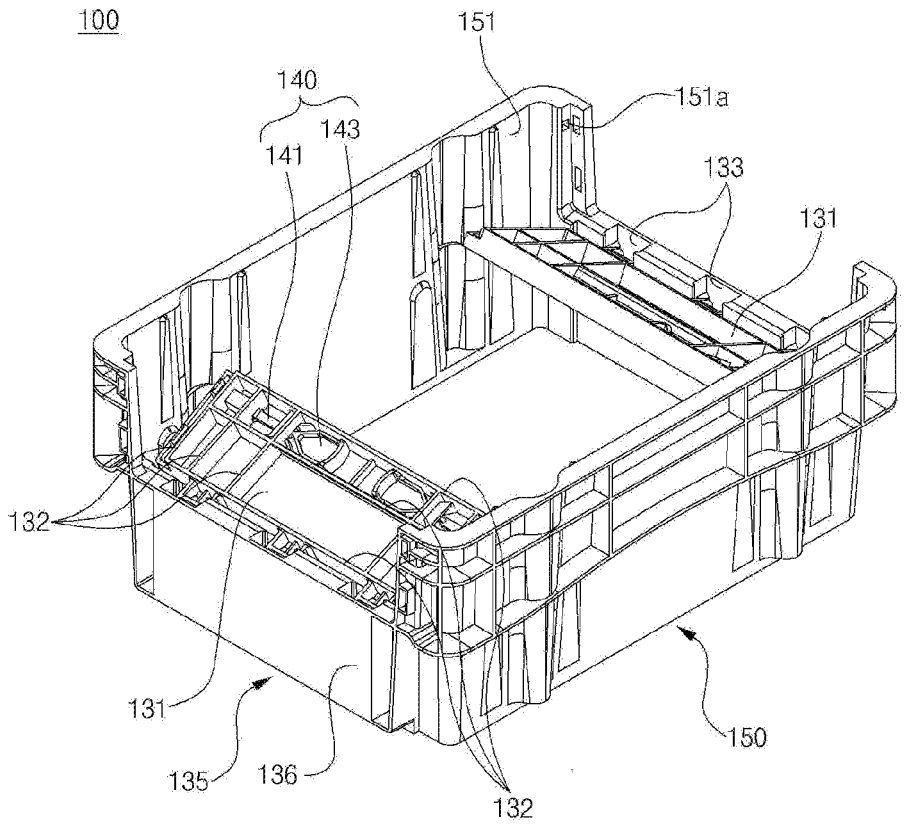
FIGS. 2 and 3 are perspective views showing a state in which upper faces of short side panels of FIG. 1 are being folded.

A lower end of the upper face 131 is connected to an upper end of the lower face 135 via a hinge portion 133, so that the upper face 131 is hingedly rotatable. As shown in FIG. 2, the upper face 131 is rotated inwards relative to the lower face 135, so that the upper end of the upper face 131 comes into contact with the base panel 110 and thus the upper face 131 is folded down.

Figure 3:
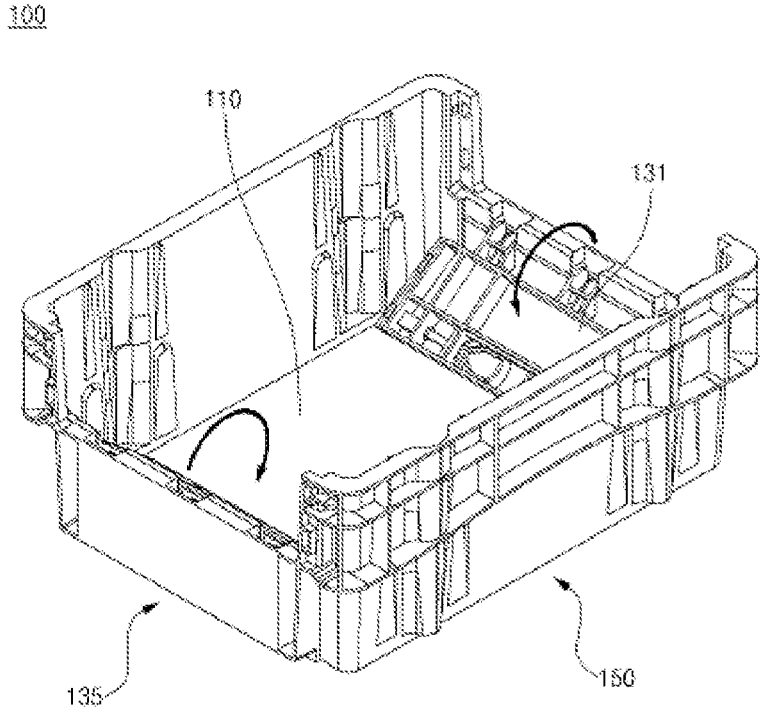

As such, a completely folded state of the upper face 131 is shown in FIG. 3. Here, only the upper end of the upper face 131 comes into contact with the base panel 110. Even if the upper face 131 is completely folded, the upper face 131 is obliquely placed.

Further, as shown in FIG. 2, a plurality of first ribs 132 is provided horizontally and vertically on an outer surface of the upper face 131 in such a way as to protrude therefrom. Particularly, the first ribs 132 preferably include an upper-end rib that is disposed on the uppermost end of the upper face 131 along the uppermost end thereof, and a lower-end rib that is disposed on the lowermost end of the upper face 131 along the lowermost end thereof. A first intermediate rib is positioned between the upper-end rib and the lower-end rib. Further, it is preferable to include a left rib provided on the left of the upper face 131 along the left thereof and a right rib provided on the right of the upper face 131 along the right thereof. A plurality of second intermediate ribs is located between the left rib and the right rib.

Moreover, a locking means 140 is preferably provided on the upper face 131 to maintain an erected state when the upper face 131 is erected up.

According to this embodiment, the locking means 140 is provided between the upper-end rib and the first intermediate rib.

Preferably, such a locking means 140 includes a pin portion 141 that passes through the second intermediate ribs, and a manipulating portion 143 that is provided on one end of the pin portion 141 to make it convenient to manipulate with the fingers.

Figure 4:
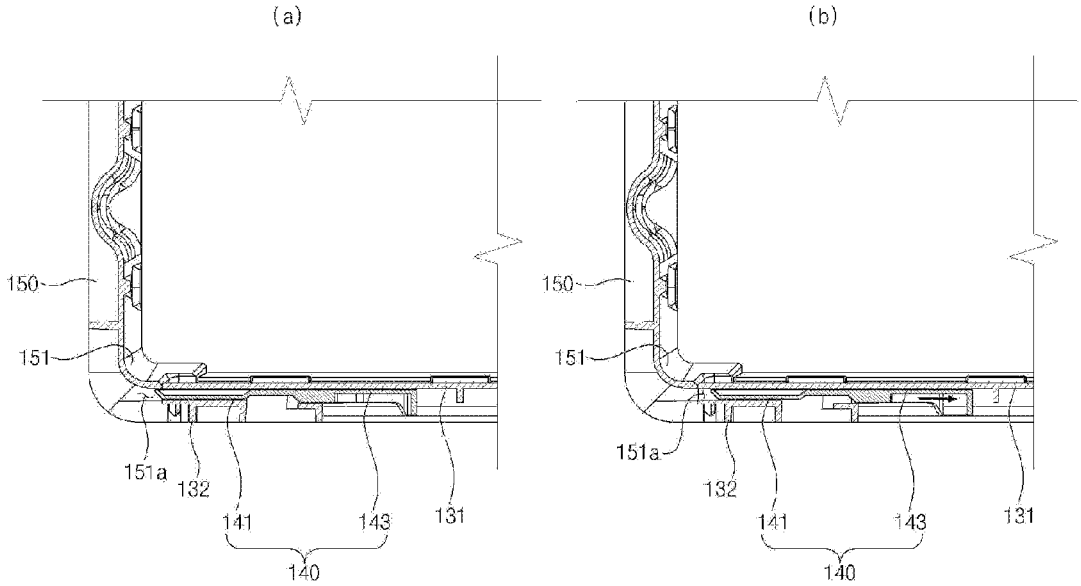
FIGS. 4A and 4B are partial sectional views showing the operation of a locking means of FIG. 1.

As shown in FIG. 4A, the other end of the pin portion 141 passes through the left rib 132 or the right rib 132 in such a way as to protrude outwards. That is, the pin portion 141 is elastically supported by a resilient rib (not shown) in a direction in which the pin portion 141 protrudes outwards.

The other end of the pin portion 141 passing through the left rib 132 or the right rib 132 in such a way as to protrude outwards is inserted into a pin insertion hole 151*a* that is formed in the sidewall of a long side panel 150 adjacent to the upper face 131.

The operation of the locking means 140 constructed as described above is as follows.

As shown in FIG. 4A, in the state in which the other end of the pin portion 141 elastically supported by the resilient rib passes through the left rib 132 in such a way as to protrude outwards and is inserted into the pin insertion hole 151*a*, if a user pushes the manipulating portion 143 rightwards with his or her fingers, the pin portion 141 is removed from the pin insertion hole 151*a* as shown in FIG. 4B, so that the pin portion 141 is located inside the left rib 132. In this state, the upper face 131 may be folded.

In contrast, if the folded upper face 131 is erected up, the pin portion 141 elastically supported by the resilient rib passes through the left rib 132 to protrude outwards and is inserted into the pin insertion hole 151*a*. Thus, the upper face 131 can maintain its erected state.

As shown in FIG. 2, a protruding surface 136 is formed on the lower face 135 in such a way as to protrude to an extent by which the first rib 132 formed on the upper face 131 protrudes.

Figure 5:
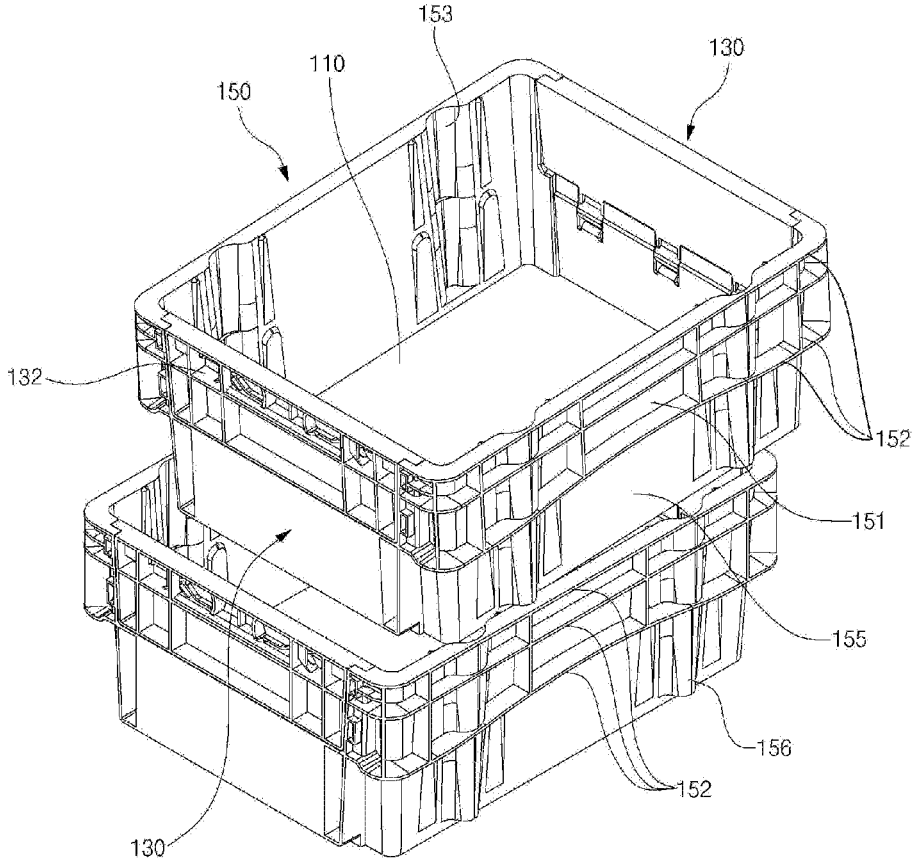
FIG. 5 is a perspective view showing the operation of a protruding portion of FIG. 1.

Meanwhile, as shown in FIG. 5, a pair of second side panels 150 is erected along the remaining facing edges of the base panel 110. In this embodiment, the second side panels 150 will be long side panels 150 that are erected on both sides of the base panel 110 having a longer length.

Thus, each second side panel 150 will be described below as the long side panel 150, but may become the short side panel without being limited to the long side panel.

Figure 7:
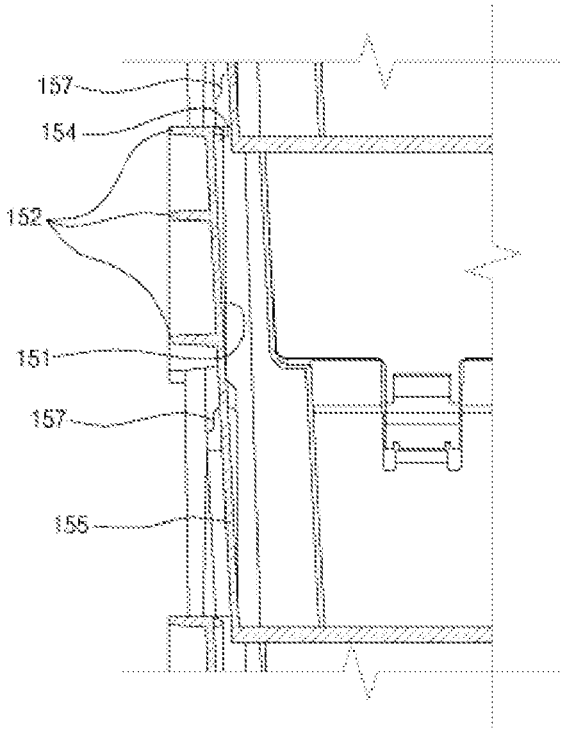

As shown in FIG. 7, each long side panel 150 is preferably obliquely erected in such a way as to be flared in a direction from the base panel 110 to an upper position, thus being able to overlap each other. Further, as shown in FIG. 5, the long side panel 150 extends past a corner of the base panel 110 to the short side panel 130.

Preferably, such a long side panel 150 is divided into two portions along a horizontal line, that is, an upper portion 151 and a lower portion 155.

A plurality of second ribs 152 protrudes from an outer surface of the upper portion 151 in such a way as to be arranged horizontally and vertically, and preferably has the same shape as the first ribs 132 formed on the outer surface of the upper face 131 of the short side panel 130. Particularly, the first ribs 132 arranged horizontally are preferably connected to the second ribs 152 which are also arranged horizontally.

Figure 6:
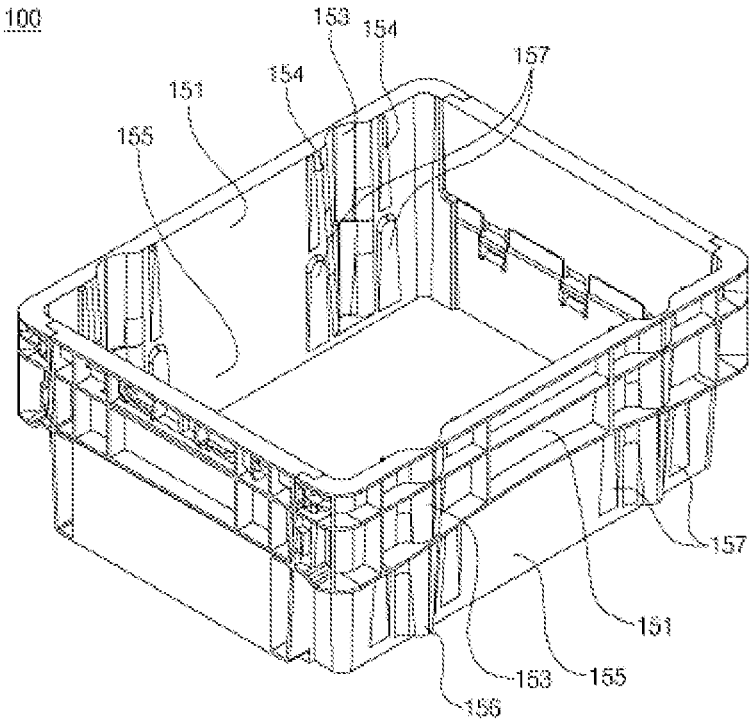
FIGS. 6 and 7 are a perspective view and a partial sectional view, respectively, showing a projecting portion and a receiving groove of FIG. 1.

Moreover, as shown in FIG. 6, an outwardly protruding portion 156 is formed on the outer surface of the lower portion 155 in such a way as to extend vertically. A receiving portion 153 is formed on the inner surface of the upper portion 151 in such a way as to extend vertically, thus receiving the protruding portion 156.

According to this embodiment, the protruding portion 156 and the receiving portion 153 are arranged vertically in a row, thus forming a curved surface that protrudes from an inner position to an outer position of each long side panel 150.

The protruding portion 156 formed as such prevents a problem wherein a carrier box located at an upper position may easily fall onto another carrier box located at a lower position unless the short side panels 130 supporting the load make contact with each other when the overlappable carrier boxes are stacked in multiple layers. That is, the protruding portion 156 is formed, so that the protruding portion 156 makes contact with the upper end of the long side panel 150 even if the short side panels 130 make contact with each other because the carrier boxes are not stacked at precise positions when they are stacked up as shown in FIG. 5, thus preventing the carrier box at the upper position from easily falling onto the carrier box at the lower position.

Furthermore, as shown in FIG. 7, projecting portions 154 are formed on the inner surface of the upper portion 151 in such a way as to protrude inwards, while receiving grooves 157 are formed on the outer surface of the lower portion 155 to receive the projecting portions 154.

According to this embodiment, as shown in FIG. 6, each projecting portion 154 is shaped to be widened in a direction from an upper position to a lower position thereof, and each receiving groove 157 is also shaped to be widened in a direction from an upper position to a lower position thereof. Further, in this embodiment, the projecting portions 154 are disposed on opposite sides of the receiving portion 153 in such a way as to extend vertically, and the receiving grooves 157 are disposed on opposite sides of the protruding portion 156 in such a way as to extend vertically. Further, in this embodiment, the shape of each receiving groove 157 is that of a curved surface that protrudes from an outer position to an inner position of the lower portion 155.

As such, the projecting portions and the receiving grooves 157 are formed, thus minimizing the lateral tolerance that may be increased between the upper box and the lower box when the overlappable carrier boxes are stacked up in multiple layers, and thereby eliminating a lateral clearance.

Hereinafter, the use of the foldable and overlappable carrier box according to the preferred embodiment of the present invention constructed as described above will be described.

First, when each carrier box 100 is used with articles or parts held therein, the upper face 131 of each short side panel 130 is erected as shown in FIG. 1.

In this case, as shown in FIG. 4A, the pin portion 141 of the locking means 140 passes through the left rib to protrude outwards and is inserted into the pin insertion hole 151*a*, thus allowing the upper face 131 to stay in the erected state.

Figure 8:
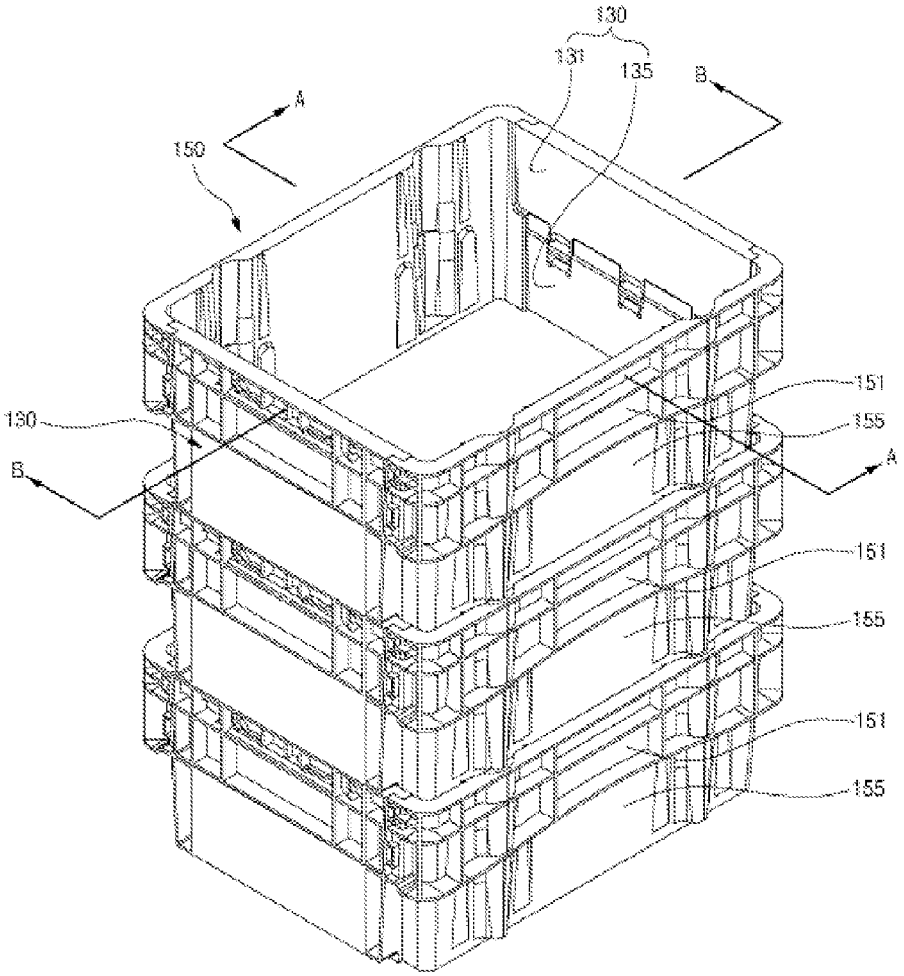
FIG. 8 is a view showing a state in which carrier boxes of FIG. 1 are stacked up.

In the case of stacking several carrier boxes 100 up in such a state, the carrier boxes 100 may be stacked and used as shown in FIG. 8.

Figure 9:
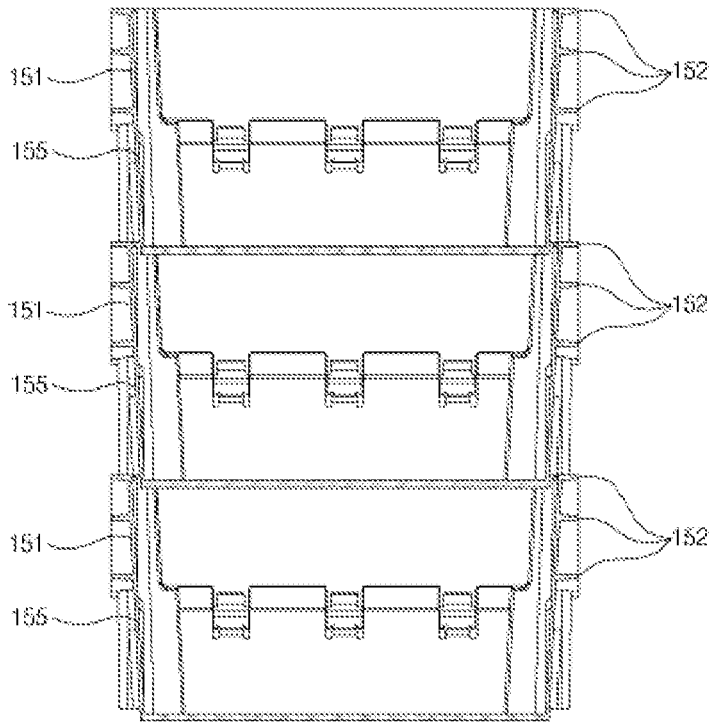
FIG. 9 is a sectional view taken along line A-A of FIG. 8.

That is, as shown in FIG. 9, the long side panel 150 of the upper carrier box 100 does not come into contact with the long side panel 150 of the lower carrier box 100, so that the long side panel 150 is never subjected to the load of the carrier box 100.

Figure 10:
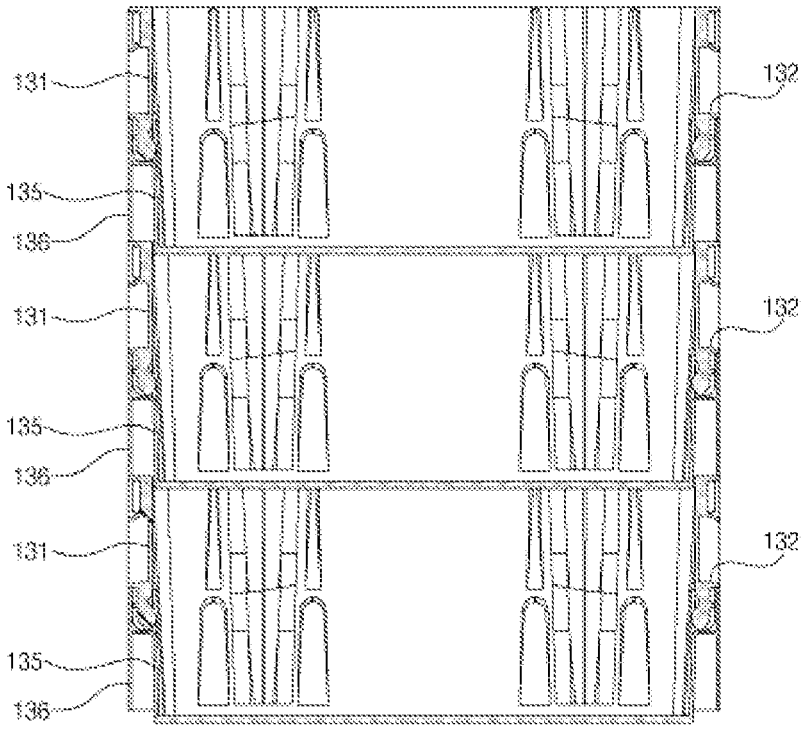
FIG. 10 is a sectional view taken along line B-B of FIG. 8.

In contrast, as shown in FIG. 10, the lower face 135 of the short side panel 130 of the upper carrier box 100 comes into contact with the upper face 131 of the short side panel 130 of the lower carrier box 100, so that the short side panel 130 supports the load of the carrier box 100.

Next, when the carrier box 100 is not in use and is collected to be moved or stored, as shown in FIG. 3, the upper face 131 of the short side panel 130 is folded down.

That is, when the upper face 131 is folded when in the erect state, the locking means 140 must be released. If the manipulating portion 143 of the locking means 140 is pushed to the right, as shown in FIG. 4*b*, the pin portion 141 is removed from the pin insertion hole 151*a* and is located inside the left rib, so that the upper face 131 may be folded.

Figure 11:
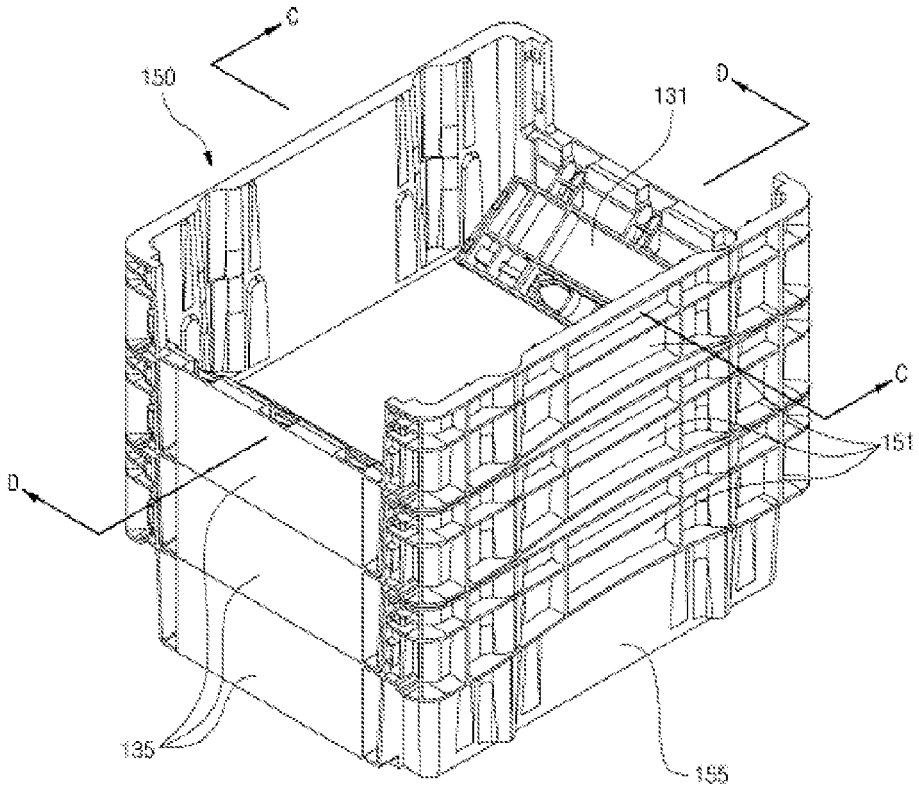
FIG. 11 is a view showing a state in which the carrier boxes of FIG. 1 are overlapped.

As such, as shown in FIG. 3, after the upper face 131 is rotated inwards and folded so that the upper end of the upper face 131 comes into contact with the base panel 110, several boxes can be overlapped as shown in FIG. 11.

Figure 12:
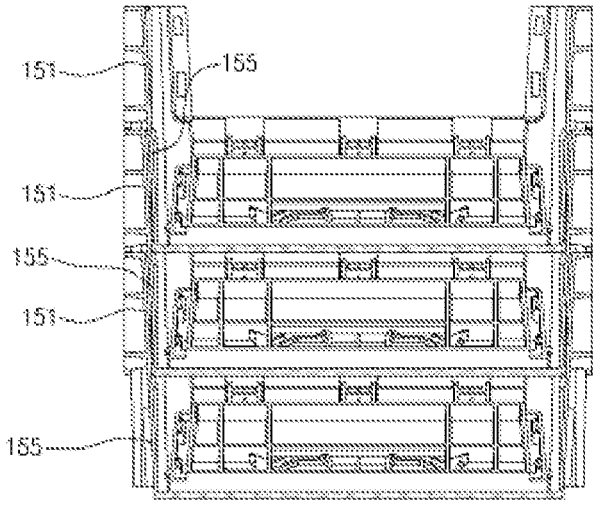
FIG. 12 is a sectional view taken along line C-C of FIG. 11.

That is, as shown in FIG. 12, since the long side panel 150 is obliquely erected to overlap each other, the lower portion 155 of the upper carrier box 100 is overlappable with the upper portion 151 of the lower carrier box 100.

Figure 13:
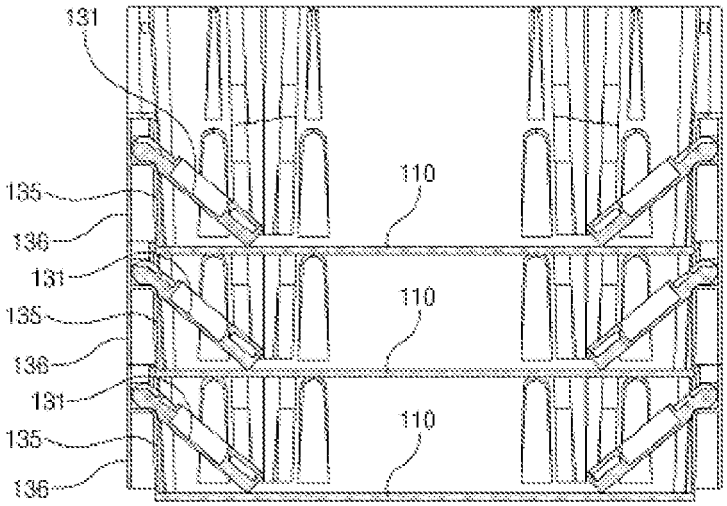
FIG. 13 is a sectional view taken along line D-D of FIG. 11.
Figure 14:
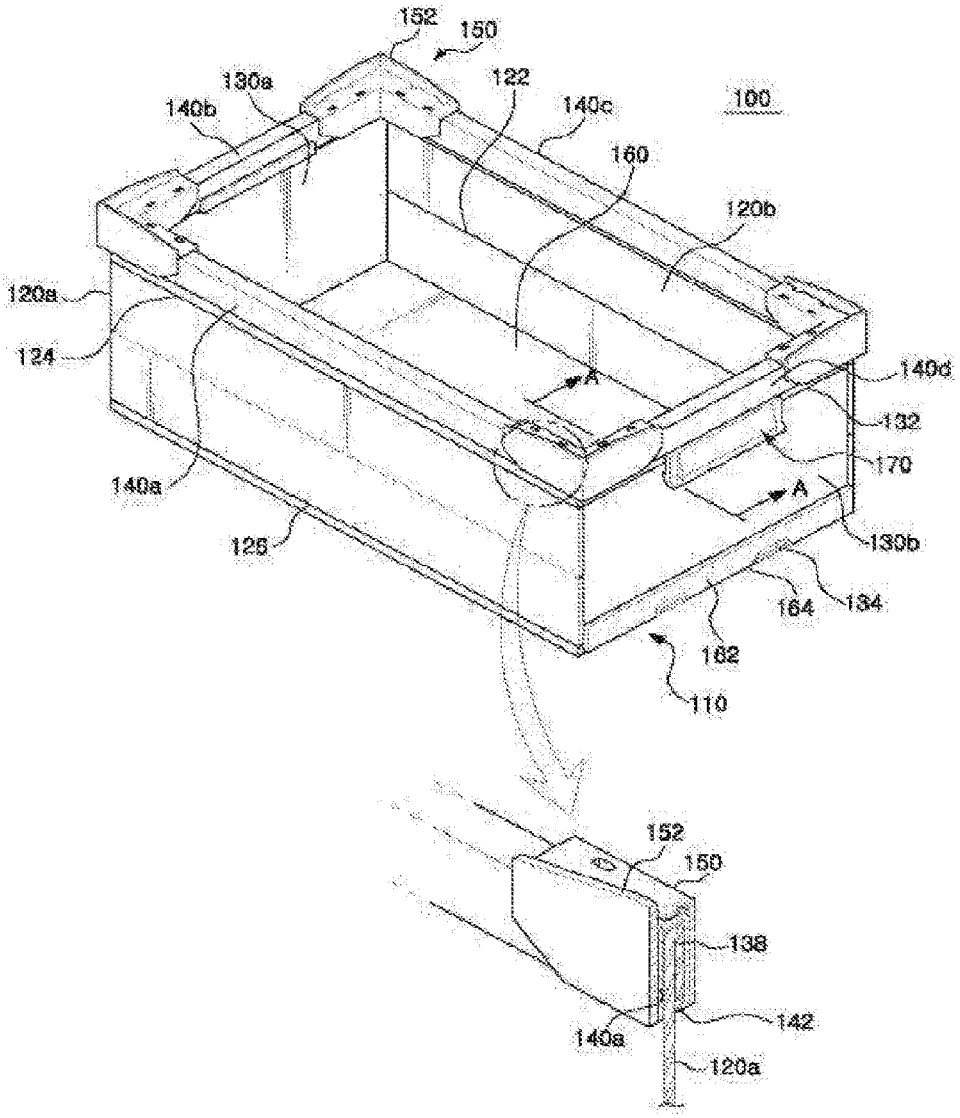
FIG. 14 is a perspective view showing a conventional foldable box.

Further, as shown in FIG. 13, the upper face 131 supporting the load of the short side panel 130 is folded inwards. In this state, in the case of overlapping the carrier boxes 100, the lower face 135 of the short side panel 130 of the upper carrier box 100 comes into contact with the lower face 135 of the short side panel 130 of the lower carrier box 100.

As such, the short side panels 130 support the load, and are not able to overlap each other, so that they are foldable. The long side panels 150 do not support any load, and are able to overlap each other. Thus, the short side panels 130 do not overlap each other, and so it is possible for the installation of the ribs to reinforce the strength.

When using the carrier boxes 100 as such, the upper faces 131 of the short side panels 130 are erected, so that it is possible to stack the carrier boxes 100 with contents held therein. When storing and collecting the empty carrier boxes 100, the upper faces 131 of the short side panels 130 can be folded and overlap each other, thus accomplishing a reduction in volume.

Therefore, the present invention can simultaneously attain high strength which is the advantage of the foldable box, and be easy to use which is the advantage of the overlappable box, in addition to reducing the manufacturing cost.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A foldable and overlappable carrier box, comprising:

a base panel;

a pair of first side panels erected along any two facing edges of the base panel; and a pair of second side panels erected along remaining facing edges of the base panel, wherein each of the first side panels is divided into an upper face and a lower face along a horizontal line, the upper face being foldable downwards, and each of the second side panels is divided into an upper portion and a lower portion along a horizontal line, whereby, when carrier boxes are stacked in multiple layers by folding the upper faces, the lower portions of a carrier box located at an upper position are overlappable with the upper portions of a carrier box located at a lower position.

2. The foldable and overlappable carrier box as set forth in claim 1, wherein the base panel has a rectangular shape, each of the first side panels is a short side panel that is erected on a short side of the base panel, and each of the second side panels is a long side panel that is erected on a long side of the base panel.

3. The foldable and overlappable carrier box as set forth in claim 1, wherein a lower end of the upper faces is hingedly connected to an upper end of the lower faces, and the upper faces are rotated inwards relative to the lower faces to be folded.

4. The foldable and overlappable carrier box as set forth in claim 3, wherein the upper faces are provided with locking means to maintain the upper faces in an erected state when the upper faces are erected.

5. The foldable and overlappable carrier box as set forth in claim 1, wherein a protruding portion is formed on an outer surface of the lower portions in such a way as to protrude outwards, and a receiving portion is formed on an inner surface of the upper portions to receive the protruding portion.

6. The foldable and overlappable carrier box as set forth in claim 1, wherein a projecting portion is formed on an inner surface of the upper portions in such a way as to protrude inwards, and a receiving groove is formed on an outer surface of the lower portions to receive the projecting portion.

7. The foldable and overlappable carrier box as set forth in claim 1, wherein the base panel has a rectangular shape, each of the first side panels is a long side panel that is erected on the long side of the base panel, and each of the second side panels is a short side panel that is erected on the short side of the base panel.

* * * * *